US007445045B2

(12) United States Patent
East, Jr. et al.

(10) Patent No.: US 7,445,045 B2
(45) Date of Patent: Nov. 4, 2008

(54) METHOD OF OPTIMIZING PRODUCTION OF GAS FROM VERTICAL WELLS IN COAL SEAMS

(75) Inventors: Loyd E. East, Jr., Frisco, TX (US); S. Dana Weida, Carrollton, TX (US); Mohamed Y. Soliman, Plano, TX (US); Jim B. Surjaatmadja, Duncan, OK (US)

(73) Assignee: Halliburton Energy Services, Inc., Ducnan, OK (US)

( * ) Notice: Subject to any disclaimer, the term of this patent is extended or adjusted under 35 U.S.C. 154(b) by 245 days.

(21) Appl. No.: 10/727,453

(22) Filed: Dec. 4, 2003

(65) Prior Publication Data

US 2005/0121196 A1 Jun. 9, 2005

(51) Int. Cl.
*E21B 43/27* (2006.01)

(52) U.S. Cl. ..... 166/308.1; 166/254.2; 166/297; 175/67; 299/10; 299/12; 299/17

(58) Field of Classification Search ..... 166/308.1, 166/254.2, 297; 299/10, 12, 17; 175/67
See application file for complete search history.

(56) References Cited

U.S. PATENT DOCUMENTS 4,744,245 A * 5/1988 White ..... 166/250.09
5,499,678 A 3/1996 Surjaatmadja et al. ..... 166/298
5,765,642 A 6/1998 Surjaatmadja ..... 166/297
5,890,536 A * 4/1999 Nierode et al. ..... 166/308.1
6,024,171 A * 2/2000 Montgomery et al. ..... 175/67
6,280,000 B1 * 8/2001 Zupanick ..... 299/12
6,604,580 B2 8/2003 Zupanick et al. ..... 166/245
7,017,665 B2 * 3/2006 Nguyen ..... 166/297
7,032,671 B2 * 4/2006 Aud ..... 166/308.1

OTHER PUBLICATIONS

U.S. Appl. No. 10/728,295, entitled "Methods for Geomechanical Fracture Modeling" by Mohamed Y. Soliman, et al.

* cited by examiner

*Primary Examiner*—Richard E. Chilcot, Jr.
*Assistant Examiner*—Matthew J Smith
(74) *Attorney, Agent, or Firm*—Robert A. Kent; Baker Botts LLP

(57) ABSTRACT

The present invention is directed to a method for producing gas from a subterranean formation containing a coal seam. The method includes the steps of drilling a substantially vertical well bore into the subterranean formation, which intersects the coal seam and fracturing the coal seam using a hydrajetting tool to produce at least one pair of opposed bi-wing fractures substantially along a plane of maximum stress. One or more horizontal well bores may also be drilled into the coal seam along which the coal seam can be further fractured.

28 Claims, 2 Drawing Sheets

METHOD OF OPTIMIZING PRODUCTION OF GAS FROM VERTICAL WELLS IN COAL SEAMS

CROSS REFERENCE TO RELATED APPLICATIONS

The present invention is related to U.S. Ser. No. 10/727,454 entitled "Method of Optimizing Production of Gas from Subterranean Formations" filed on even date herewith, which is assigned to the assignee of the present invention.

FIELD OF THE INVENTION

The present invention relates generally to subterranean well construction, and more particularly, to improved methods for producing gas from subterranean formations that include coal seams.

BACKGROUND OF THE INVENTION

Subterranean formations that include coal seams can contain substantial quantities of adsorbed methane gas. Extracting this gas may help protect mining personnel from dangerous exposures to methane and may allow the producer to derive profit from sale of the gas as an energy source. Coal's unique structure allows it to store gas through adsorption onto its surface, which is covered with micro-pores. The high density of micro-pores yields 10 to 100 square meters of surface area per gram of coal, giving coal beds the capacity to store significant amounts of gas.

Generally, the closer wells are spaced, the greater gas recovery may be over the economic life of the wells. Ideally, wells are spaced to maximize gas liberation by minimizing the reservoir pressure in the coal seam across a large area. Coal seams are different from other hydrocarbon reservoirs in this respect—the reservoir pressure needs to be reduced to release the gas from coal. Because subterranean water often accompanies methane gas in coal seams, reservoir pressure can be reduced by removing this water while preventing localized water recharge. This reduction in water pressure can be achieved by spacing many wells in close proximity, with the actual distance between each well determined by the permeability of the coal seam, among other factors. The production of gas by one well will reduce the pressure in the reservoir and affect production by neighboring wells. This amount of well "interference" is determined by a number of factors, including, but not limited to, factors such as permeability, permeability anisotropy and well spacing. The reduced pressure resulting from this interference allows gas to desorb from the coal quicker, which improves the early economics of the field development. A more effective mechanism is to allow a higher pressure drop to be transmitted deeper into the formation. A fractured system is significantly more effective in accomplishing this than a radial flow system. Wells are spaced to yield maximum interference within four to six years. This spacing allows for maximum production within a feasible economic time frame. Furthermore, the less distance a gas or water molecule must travel to a well, the greater production will be within the economic time frame of the wells. Therefore, well spacing is a critical design element in any gas production system.

The fracturing of coal seams often requires very high pressures in comparison to other types of formations. In sandstone, for example, the fracture gradient may be 0.7 psi/ft or maybe 0.85 psi/ft or 0.9 psi/ft at the most. In coal seams, however, the pressure gradient may be 1.0, 1.2, 1.5 and even as high as 3.0. In a conventional rock formation, the fracture gradient normally represents the in situ stress, the minimum horizontal stress. In a coal seam, the fracture gradient represents stresses plus the difficulty to extend the fracture, and that difficulty can be greater than the magnitude of the stresses. There is a significant pressure drop due to tortuosity, which are twists and bends in the formation, which are pervasive in coal seams.

Prior solutions have been developed in an attempt to reduce the fracture gradient in coal. Typically, these solutions have been focused on optimizing the viscosity of the fracturing fluid. If water is used as the fracturing fluid, which has a viscosity of 1.0, a fracture gradient of 3.0 is generated. If a linear gel is used, the fracture gradient drops to 2.0-2.5. Foam yields a fracture gradient of 1.0-2.0 and a crosslinked gel yields a fracture gradient of 1.0-1.5. It turns out, contrary to logic, that the higher viscosity fluids yield lower stresses, and the lower viscosity fluids yield higher stresses. This is because a higher viscosity fluid gives a wider fracture—a single, dominant fracture, with few competing fractures. Although operators have had success with optimizing the fracturing fluids for coal seams, they are still confronted with fracture initiation difficulties associated with the perforations in cased wells, and fracture initiation and containment difficulties in open hole wells.

Another problem with fracturing coal seams is the creation of "near-well-bore stresses." This occurs when the coal seam, which is naturally-fractured, is perforated and fractured and is particularly problematic in vertical wells because formation stresses vary with depth. The perforations, which are scattered along a varied depth of the well bore, create multiple and random entry points for the fracture fluid to flow into the formation. This random flowpath coupled with an already tortuous network of pathways within the coal seam formation results in a complex fracture, which is typically not aligned with the plane of maximum stress and lacks a single, dominate fracture. Thus, an inefficient and often sometimes ineffectual pathway for the gas to reach the well bore is created.

SUMMARY OF THE INVENTION

The present invention relates generally to subterranean well construction, and more particularly, to improved methods for producing gas from subterranean formations that include coal seams.

The present invention is directed to a method for producing gas from a subterranean formation containing a coal seam. The method includes the steps of drilling a substantially vertical well bore into the subterranean formation, which intersects the coal seam and fracturing the coal seam using a hydrajetting tool to produce at least one pair of opposed bi-wing fractures substantially along a plane of maximum stress. The fluid being discharged from the hydrajetting tool is injected into the formation at a pressure, which is below the pressure that will fracture the coal seam. The vertical well bore may be cased and logged.

In an another embodiment according to the present invention, at least one horizontal well bore is formed in the coal seam, which may or may not intersect with the vertical well bore that communicates with the bi-wing fractures. The at least one horizontal well bore is also fractured, preferably using a hydrajetting tool that produces one or more pairs of opposing bi-wing fractures. The number, placement and size of these fractures are preferably optimized to maximize interference, which enhances gas production.

In yet another embodiment according to present invention, the method includes a plurality of substantially horizontal well bores drilled within the coal seam and exiting from the at least one substantially vertical well bore. The plurality of substantially horizontal well bores is spaced to maximize interference between the substantially horizontal well bores. The plurality of horizontal well bores is fractured using a hydrajetting tool to produce a plurality of fractures. The plurality of fractures is spaced to maximize interference between fractures and enhance the production of gas from the coal seam of the subterranean formation.

An advantage is this method is that since the fluid is injected into the formation below the fracture pressure, the formation of unintended fractures in undesirable orientations are minimized thus significantly limiting the "near-well-bore stress" effect. Other features and advantages of the present invention will be readily apparent to those skilled in the art upon a reading of the description of the preferred embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
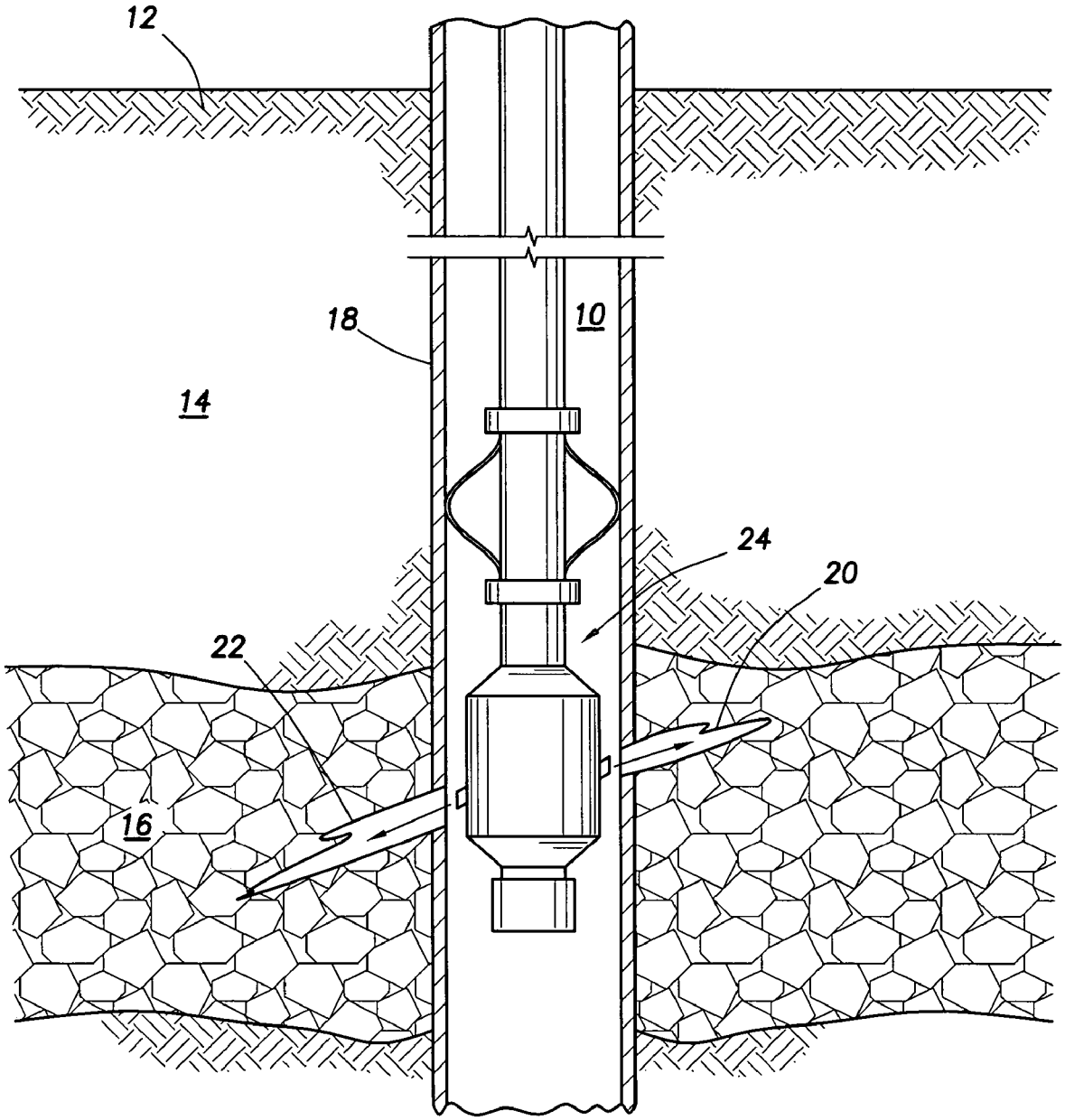
FIG. 1 is a cross-sectional side view of a vertical well bore intersecting a coal seam being fractured bi-directionally with a hydrajetting tool in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present invention relates generally to subterranean well construction, and more particularly, to improved methods for producing gas from subterranean formations that include coal seams. FIG. 1 depicts initial steps of an exemplary embodiment of the present invention. At least one substantially vertical well is drilled into a subterranean formation such that each substantially vertical well bore intersects with one or more coal seams. An exemplary substantially vertical well bore 10, shown in FIG. 1, is drilled from the surface 12 through subterranean formation 14 using prior art techniques. Subterranean formation 14 includes coal seam 16, which is the source of a gas.

The number of substantially vertical well bores needed to maximize gas recovery from the coal seam 16 will depend on several factors, including, but not limited to, factors such as the characteristics and limitations of the site, subterranean formation, and coal seam. In particular, the permeability of the subterranean formation and coal seam will be relevant to determining the number of vertical wells necessary. The suitable number of substantially vertical well bores will be apparent to a person of ordinary skill in the art having the benefit of this disclosure.

In an exemplary embodiment of the present invention, each substantially vertical well bore such as exemplary substantially vertical well bore 10 shown in FIG. 1 terminates at or below coal seam 16. Prior art logging equipment (not shown) may be inserted in one or more of the substantially vertical well bores after drilling to gather information about the characteristics of the subterranean formation. On the other hand, prior art measurement-while-drilling (MWD) tools may be used. Prior art logging equipment or MWD tools may be used in the at least one substantially vertical well bore if it terminates below the coal seam 16. Casing 18 may be inserted and cemented into each of the substantially vertical well bores, as shown in FIG. 1.

Figure 2:
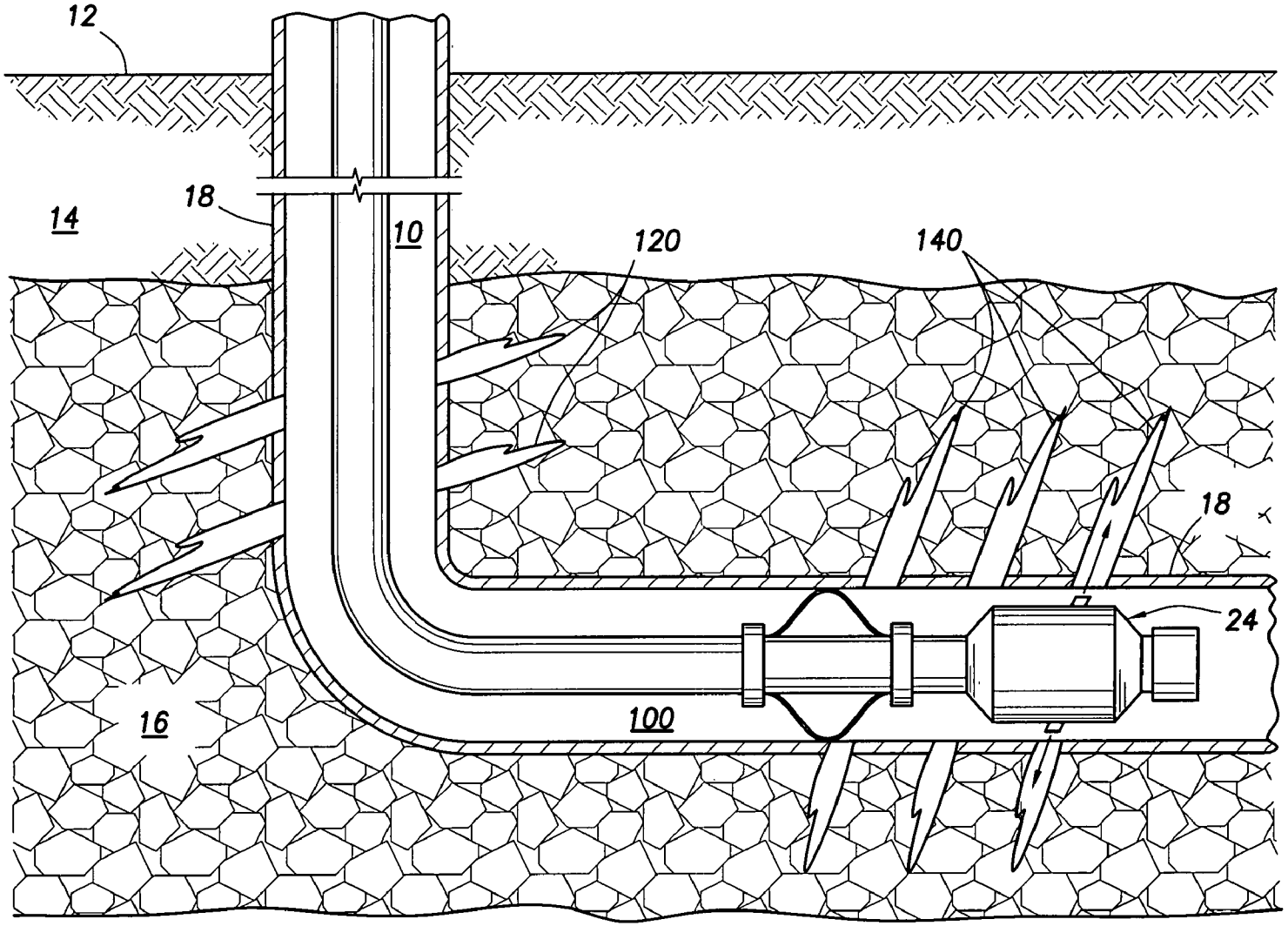
FIG. 2 is a cross-sectional side view of a vertical and horizontal well bore drilled into a coal seam being fractured bi-directionally by a hydrajetting tool in accordance with another embodiment of the present invention.

In an exemplary embodiment, a plurality of fractures is created along the vertical well bores. Once the fracturing is complete, any equipment and fluid contained within the well bores may be removed and gas production may begin. If present, water may be removed from the coal seam using prior art water removal methods. FIG. 1 shows an exemplary pair of opposed bi-wing fractures, denoted generally by reference numerals 20 and 22, created along the exemplary substantially vertical well bore 10. Successful fracturing of a few well placed vertical well bores can provide adequate coverage of coal seams without having to drill many complex horizontal well bores. Although, as those of ordinary skill in the art will appreciate, the present invention can be used in conjunction with a method that includes drilling and fracturing horizontal well bores in the coal seam 16, as illustrated in FIG. 2 and discussed below. The coal seam 16 can be successfully fractured via a vertical well bore because of advances in fracturing techniques such as those made using hydrajetting tools.

The pair of opposed fractures 20 and 22 are preferably created using a hydrajetting tool such as the SurgiFrac™ tool made by Halliburton. Hydrajetting tools and methods for their use are disclosed in U.S. Pat. Nos. 5,499,678 and 5,765,642, which are herein incorporated by reference. Use of a hydrajetting tool combines the steps of perforating and fracturing and eliminates the need for mechanically isolating the well formation. A hydrajetting tool can be inserted in a well bore and has at least one fluid jet forming nozzle that ejects fluid at a pressure sufficient to first form a cavity in the surface of a well bore (and through the casing 18, if present) and then fracture the surrounding formation by stagnation pressure in the cavity. An exemplary embodiment of the hydrajetting tool 24 will have a plurality of fluid jet forming nozzles aligned in a single plane. When the plurality of fluid jet forming nozzles of the hydrajetting tool is aligned with the plane of maximum principal stress in the formation to be fractured, a single fracture can be created at that precise location.

In the exemplary embodiment of the present invention, the hydrajetting tool 24 is inserted into the substantially vertical well bore 10 and positioned where fracturing is desired. Fluid containing a suitable prior art proppant is jetted by the hydrajetting tool 24 to fracture the coal seam at that position. A pair of opposed jet ports enable the tool to create a pair of opposed bi-wing fractures 20 and 22. The proppant is preferably discharged from the hydrajetting tool 24 at a pressure, which is less than that which will fracture the coal seam 16. Thus, the opposed bi-wing fractures 20 and 22 are formed by erosion—i.e., in effect by cutting the formation—rather than through hydraulic stresses. The avoidance of hydraulic stresses in turn eliminates, or at least minimizes, the formation of unintended fractures near the well bore. As a consequence, the fractures 20 and 22 are well defined and can be formed along the plane of maximum stress with some measure of precision. As those of ordinary skill in the art will appreciate, additional pairs of opposed bi-wing fractures can be created. FIG. 2 illustrates a plurality of pairs of opposed bi-wing fractures 120.

In another exemplary embodiment according to the present invention, a lateral or horizontal well bore 100 is formed in coal seam 16. The horizontal well bore 100 intersects vertical well bore 10. The horizontal well bore 100 may also be cased with casing 18. As those of ordinary skill in the art will recognize, however, both the vertical well bore 10 and the horizontal well bore 100 may be open hole. After the hydrajetting tool 24 has formed the plurality of pairs of opposing bi-wing fractures 120 along planes of maximum stress, it then can form a plurality of additional fractures 140 along the horizontal well bore 100. The additional fractures 140 are also preferably formed in opposed directions. The number, spacing and placement of the plurality of fractures 140 are optimized to maximum the interference between them.

The number, spacing and configuration of the fractures formed along the substantially vertical well bore 10 and the substantially horizontal well bore 100 will depend on several factors, including, but not limited to, factors such as the characteristics and limitations of the site, subterranean formation, and coal seam and will be apparent to a person of ordinary skill in the art having the benefit of this disclosure. Copending application U.S. Ser. No. 10/728,295, titled "Methods for Geomechanical Fracture Modeling," filed on even date herewith and assigned to the same assignee of this patent, discloses a method for designing and optimizing the number, placement, and size of fractures in a subterranean formation. The inventors of the present invention incorporate the disclosure of that application herein. The number of fractures that form the plurality of fractures 120 and 140, their spacing and their configuration will depend on similar factors and will be apparent to a persons of ordinary skill in the art having the benefit of the present disclosure and the disclosure of the application for "Methods for Geomechanical Fracture Modeling" incorporated herein.

Therefore, the present invention is well-adapted to carry out the objects and attain the ends and advantages mentioned, as well as those that are inherent therein. While the invention has been depicted, described, and is defined by reference to the exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only and are not exhaustive of the invention. Consequently, the invention is intended to be limited only by the spirit and scope of the appended claims, giving full cognizance to equivalents in all respects.

What is claimed is:

1. A method for producing gas from a subterranean formation comprising a coal seam, the method comprising:

drilling at least one substantially vertical well bore into the subterranean formation, which intersects the coal seam; and fracturing the coal seam using a hydrajetting tool at a pressure less than a fracture pressure of the subterranean formation to produce at least one pair of opposed bi-wing fractures formed by erosion of the subterranean formation substantially along a plane of maximum stress.

2. The method of claim 1, further comprising the step of casing the at least one substantially vertical well bore.

3. The method of claim 2, further comprising the step of perforating the casing with the hydrajetting tool.

4. The method of claim 1, further comprising the step of removing water from the coal seam of the subterranean formation.

5. The method of claim 1, further comprising the step of inserting logging equipment into the at least one substantially vertical well bore.

6. The method of claim 1, wherein during the fracturing step the hydrajetting tool produces a plurality of pairs of opposed bi-wing fractures.

7. The method of claim 1 comprising performing an additional fracturing step using the hydrajetting tool subsequent to the step of fracturing the coal seam using the hydrajetting tool.

8. The method of claim 1 wherein the step of fracturing the coal seam using a hydrajetting tool comprises discharging from the hydrajetting tool a fluid comprising proppant particulates.

9. A method for producing gas from a subterranean formation comprising a coal seam, the method comprising:

drilling at least one substantially vertical well bore into the subterranean formation, which intersects the coal seam;

fracturing the coal seam along the substantially vertical well bore using a hydrajetting tool at a pressure less than a fracture pressure of the subterranean formation to produce at least one pair of opposed bi-wing fractures formed by erosion of the subterranean formation substantially along a plane of maximum stress;

drilling at least one substantially horizontal well bore into the coal seam; and fracturing the coal seam along the substantially horizontal well bore using the hydrajetting tool at a pressure less than the fracture pressure of the subterranean formation to produce at least one pair of opposed bi-wing fractures formed by erosion of the subterranean formation.

10. The method of claim 9, further comprising the step of casing the at least one substantially vertical well bore and the at least one substantially horizontal well bore.

11. The method of claim 10, further comprising the step of perforating the casing with the hydrajetting tool.

12. The method of claim 9, further comprising the step of removing water from the coal seam of the subterranean formation.

13. The method of claim 9, further comprising the step of inserting logging equipment into the at least one substantially vertical well bore.

14. The method of claim 9, wherein during the fracturing steps the hydrajetting tool produces a plurality of pairs of opposed bi-wing fractures.

15. The method of claim 9 comprising performing an additional fracturing step using the hydrajetting tool subsequent to the step of fracturing the coal seam along the substantially horizontal well bore.

16. The method of claim 9 wherein the step of fracturing the coal seam along the substantially vertical well bore using a hydrajetting tool comprises discharging from the hydrajetting tool a fluid comprising proppant particulates.

17. A method for producing gas from a subterranean formation comprising a coal seam, the method comprising:

drilling at least one substantially vertical well bore intersecting the coal seam;

logging the subterranean formation by inserting logging equipment into the at least one substantially vertical well bore;

casing the at least one substantially vertical well bore; and fracturing the coal seam using a hydrajetting tool at a pressure less than a fracture pressure of the subterranean formation to produce at least one pair of opposed bi-wing fractures formed by erosion of the subterranean formation substantially along a plane of maximum stress.

18. The method of claim 17, further comprising the step of perforating the casing with the hydrajeffing tool.

19. The method of claim 17, further comprising the step of removing water from the coal seam of the subterranean formation.

20. The method of claim 17, wherein during the fracturing step the hydrajetting tool produces a plurality of pairs of opposed bi-wing fractures.

21. The method of claim 17 comprising performing an additional fracturing step using the hydrajetting tool subsequent to the step of fracturing the coal seam using the hydrajetting tool.

22. The method of claim 17 wherein the step of fracturing the coal seam using a hydrajetting tool comprises discharging from the hydrajetting tool a fluid comprising proppant particulates.

23. A method for producing gas from a subterranean formation comprising a coal seam, the method comprising:

drilling at least one substantially vertical well bore intersecting the coal seam;

logging the subterranean formation by inserting logging equipment into the at least one substantially vertical well bore;

casing the at least one substantially vertical well bore;

drilling a plurality of substantially horizontal well bores disposed substantially within the coal seam and exiting from the at least one substantially vertical well bore, wherein the plurality of substantially horizontal well bores is spaced to maximize interference between the substantially horizontal well bores;

casing the plurality of substantially horizontal well bores;

fracturing the coal seam along the substantially vertical well bore using a hydrajetting tool at a pressure less than a fracture pressure of the subterranean formation to produce at least one pair of opposed bi-wing fractures formed by erosion of the subterranean formation substantially along a plane of maximum stress; and fracturing the coal seam along the plurality of substantially horizontal well bores using the hydrajetting tool at a pressure less than the fracture pressure of the subterranean formation to produce a plurality of fractures formed by erosion of the subterranean formation, wherein the plurality of fractures is spaced to maximize interference between fractures and wherein the plurality of fractures enhances the production of gas from the coal seam of the subterranean formation.

24. The method of claim 23, further comprising the step of perforating the casing with the hydrajetting tool.

25. The method of claim 23, further comprising the step of removing water from the coal seam of the subterranean formation.

26. The method of claim 23, wherein during the fracturing steps the hydrajetting tool produces a plurality of pairs of opposed bi-wing fractures.

27. The method of claim 23 comprising performing an additional fracturing step using the hydrajetting tool subsequent to the step of fracturing the coal seam along the plurality of substantially horizontal well bores.

28. The method of claim 23 wherein the step of fracturing the coal seam along the substantially vertical well bore using a hydrajetting tool comprises discharging from the hydrajetting tool a fluid comprising proppant particulates.

* * * * *